United States Patent [19]

Elmore

[11] 3,933,952

[45] Jan. 20, 1976

[54] FUEL-AIR MIXING APPARATUS FOR VEHICLES

[76] Inventor: Gerald C. Elmore, P.O. Box 337, Lakeside, Oreg. 97449

[22] Filed: Dec. 5, 1974

[21] Appl. No.: 529,813

[52] U.S. Cl. ..... 261/145; 261/390; 261/50 R; 261/DIG. 19; 261/DIG. 74; 123/122 D; 123/DIG. 11; 123/97 B

[51] Int. Cl.[2] ..... F02M 1/10; F02M 31/04

[58] Field of Search... 261/50 R, 39 D, 145, DIG. 19, 261/DIG. 74; 123/122 D, DIG. 11, 97 B

[56] References Cited

UNITED STATES PATENTS

| | | | |
|---|---|---|---|
| 1,809,242 | 6/1931 | Kingston | 123/122 D |
| 1,865,514 | 7/1932 | Godward | 123/122 D |
| 2,261,992 | 11/1941 | Goldi | 123/DIG. 74 |
| 2,359,925 | 10/1944 | Leibing | 123/DIG. 11 |
| 2,399,077 | 4/1946 | Udale | 123/50 R |
| 2,600,368 | 6/1952 | Winkler | 123/50 A |
| 3,013,777 | 12/1961 | White | 123/50 R |
| 3,266,785 | 8/1966 | Kennedy, Sr. | 123/50 R |
| 3,341,185 | 9/1967 | Kennedy, Sr. | 123/50 R |
| 3,587,553 | 6/1971 | Sutton | 261/39 D |
| 3,695,591 | 10/1972 | Caisley | 123/39 D |
| 3,730,153 | 5/1973 | Harrison et al. | 123/DIG. 11 |

*Primary Examiner*—Tim R. Miles
*Attorney, Agent, or Firm*—James D. Givnan, Jr.

[57] ABSTRACT

A fuel-air vaporizing apparatus including fuel metering means discharging a regulated fuel flow into a heated airflow within a conduit for subsequent and remote discharge into the air induction system of an engine. A nozzle structure, subjected to vacuum pressure, discharges fuel below an induction regulating valve. Fuel and air linkage, jointly operated by the driver's throttle, actuate said fuel metering means and the air induction regulating valve in a synchronized manner to provide an optimum, completely vaporized fuel-air mixture to the engine. An idle assembly controls engine operation during both idling and other closed throttle conditions. Said idle assembly functions to cut off fuel flow during vehicle deceleration with fuel flow resuming upon certain engine conditions being reached. Temperature responsive means are associated with both the idle assembly and the fuel-air linkage to assure optimum fuel-air ratios throughout a range of engine temperatures.

13 Claims, 4 Drawing Figures

FUEL-AIR MIXING APPARATUS FOR VEHICLES

BACKGROUND OF THE INVENTION

The instant invention pertains to a multiple stage fuel-air mixing apparatus affording both primary mixing of the fuel-air charge within a conduit with secondary mixing of the charge taking place within the regulated induction airflow of an engine. Means responsive to engine conditions terminates fuel flow during vehicle deceleration.

The present apparatus is a substantial departure from existing automotive carburetion systems and dispenses with the need for standard carburetor components such as jets, floats, and intricate adjustment means therefor. The highly complex nature of automotive carburetors renders them costly to manufacture, install and service, the latter requiring the services of a highly skilled technician. While existing automotive carburetors are highly refined and do provide satisfactory economy of operation in most applications, they do not accomplish objectives of fuel economy and servicing ease associated with the present fuel-air apparatus.

SUMMARY OF THE INVENTION

The present invention is embodied within a fuel-air mixing apparatus which includes fuel metering means dispensing a fuel flow into a conduit airflow whereat first stage mixing occurs with the fuel-air mixture being discharged at a remote nozzle for second stage mixing with induction air in an intake barrel serving the engine intake manifold.

A fuel-air linkage includes both fuel and air regulating components both responsive to throttle linkage to regulate fuel flow and the flow of induction air. Temperature responsive means reduces induction airflow during cold engine operation. An idle assembly controls fuel flow both during idling and periods of high vacuum in the intake manifold and in the latter instance serves to terminate all fuel flow during certain engine conditions associated with deceleration. A vacuum dash pot is responsive to intake manifold vacuum and regulates fuel metering means during closed throttle high vacuum conditions to cut off fuel flow for economy purposes with fuel flow recommencing upon a lesser manifold pressure being reached. A heat sensitive member in the idle linkage modifies vacuum dash pot-armature operation to best suit hot and cold engine idle conditions. Similarly, the fuel-air linkage includes temperature responsive means for limiting induction air during cold engine operation.

Important objectives of the present apparatus include: the provision of a fuel-air mixing apparatus providing dual stage mixing with the first stage occurring within a conduit airflow with second stage mixing occurring as the fuel-air admixture is discharged into an induction airflow to fully vaporize the fuel; the provision of a fuel-air mixing apparatus using heated air during first stage mixing with the admixture being cooled prior to second stage mixing for purposes of volumetric efficiency; the provision of a fuel-air mixing apparatus achieving a higher air to fuel ratio than is attainable with conventional fuel-air mixing devices to affect increased mileage and a reduction in unburned hydrocarbons and other engine emissions; the provision of a fuel-air mixing apparatus capable of cutting off the fuel flow during certain engine conditions associated with periods of vehicle deceleration for fuel conservation and a reduction of engine emissions; the provision of a fuel-air mixing apparatus of substantially less complexity than existing carburetors yet one fully capable of compensating during open throttle and idling for high and low engine operating temperatures; and the provision of a fuel-air mixing apparatus of low manufacturing cost having uncomplicated, readily accessible components for ease of installation and servicing.

DESCRIPTION OF THE PREFERRED EMBODIMENT

Figure 1:
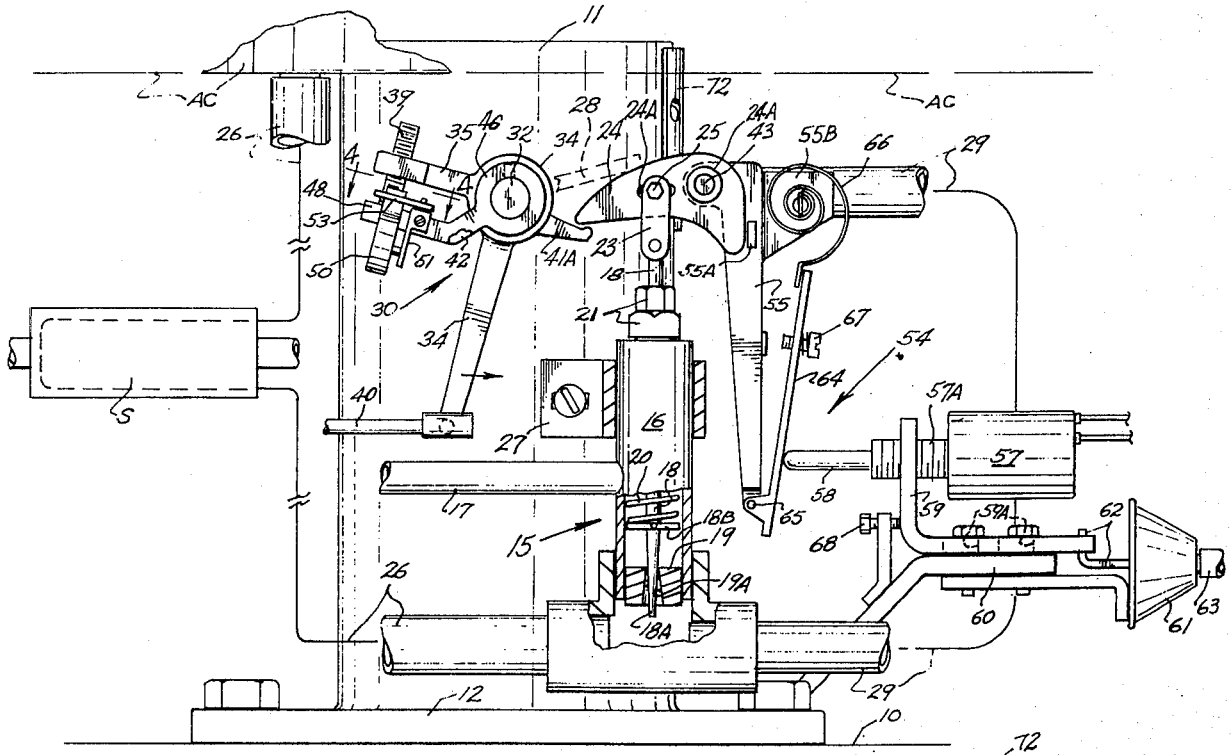
FIG. 1 is a side elevational view of the apparatus with certain related vehicle components being shown in a schematic manner.

With continuing reference to the accompanying drawings wherein applied reference numerals indicate parts similarly identified in the following specification, the reference numeral 10 indicates an intake manifold of an internal combustion engine having passageways serving each of the engine combustion chambers. The intake manifold may be of the type including additional passageways for the flow of heated air or exhaust to accomplish heating of the fuel-air mixture prior to combustion chamber entry. Reference numeral 11 indicates a cylindrical structure, hereinafter termed a barrel, suitably secured to the intake manifold by means of a bolted flange 12. The upper end of barrel 11 is adapted to mount the base of an air cleaner assembly at AC in a manner not dissimilar to the mounting arrangement for conventional carburetors. The air cleaner base may be recessed for assuring adequate under hood clearance, however such clearance is not critical as the overall height of the present apparatus is approximately equal to existing carburetor and air cleaner combinations. While only a single barrel is shown, it is to be understood that in some engine applications of the present apparatus it may be desirable to use multiple barrels. Such adaptation of the apparatus is believed to be within the scope of one skilled in the art and accordingly comes within the scope of the appended claims.

Fuel metering means is indicated generally at 15 and is embodied within a valve assembly including a valve housing 16 served interiorly by a pressurized fuel line 17. Valve housing 16 receives a core 18 mounted for reciprocal movement with a spring 20 biasing the core lower end at 18A downwardly towards a closed or seated position in a valve seat 19 having an orifice 19A. Details of the valve and valve seat are hereinafter elaborated upon with present purposes served by identifying the valve as of the needle valve type. The upper end of valve housing 16 is sealed by a suitable packing and nut assembly 21. An exterior segment of core 18 is pivotally coupled by a pair of links 23 to a fuel lever 24 the latter constituting core positioning means having a slotted area at 24A to permit selective reception of a fastener assembly 25 and hence the effective throw of lever 24 to be varied with respect to the rectilinear travel of core 18. A bracket 27 permits repositioning of valve housing 16 on barrel 11. From the foregoing it will be seen that upward movement of lever 24 will unseat the lower end segment 18A of core 18 resulting in the metered discharge of fuel inot an airflow delivered to the metering means via an air conduit 26. A flow of filtered air originates at air cleaner AC and is routed past a heat exchanger arrangement such as along an exhaust header shroud S. A fuel-air mixture conduit is indicated at 29.

Fuel and air linkage is indicated generally at 30 and includes a fuel-air control 34 mounted for rotatable movement about a shaft 32 suitably journalled in bearing sleeves 33. Shaft 32 projects through barrel 11 to support an air induction butterfly valve 28. Integral with fuel-air control 34 is a laterally projecting fuel-air arm 35 which serves the dual purpose of actuating both fuel and air regulating components. A projection 36 on fuel-air arm 35 mounts an adjustment screw 37 for fuel flow regulating purposes while a like projection at 38 mounts an adjustment screw 39 for actuation of butterfly 28 as later explained. The lower end of fuel-air control lever 34 is in pivotal connection with throttle linkage at 40 with movement of the linkage 40 in the applied arrow direction associated with an increase in engine speed.

For actuation of fuel metering means 15 and regulating fuel discharge therefrom for first stage fuel-air mixing, upward motion is imparted to fuel lever 24 by a tang 41A formed on a ring 41 rotatably mounted about butterfly shaft 32. Also integral with ring 41 is a fuel arm 42 extending laterally from the ring into subjacent relationship with projection 36 of fuel-air arm 35. Ring 41 and its appurtenances constitute a fuel regulating component of the fuel and air linkage. Accordingly, adjustment screw 37 carried by projection 36 on fuel-air arm 35 is contactable with arm 42 to rock tang 41A upwardly about the axis of shaft 32 with resulting core lifting movement of lever 24 occurring about the axis of a lever supporting spindle 43. A set screw 44 secures a collar 24A of the lever to a spindle 43 which, in turn, is journalled within a bracket mounted sleeve 45.

For regulating butterfly 28 and hence induction air into barrel 11, a second ring at 46 is secured by a set screw 47 to butterfly shaft 32 said ring having an air arm 48 disposed subjacent projection 38 of fuel-air arm 35. Adjustment screw 39 on projection 38 is contactable with arm 48 upon counterclockwise travel (FIG. 1) of control 34 during engine acceleration to rotate shaft 32 and butterfly 28 towards an open position. Ring 46 and its arm 48 constitute an air regulating component.

Figure 4:
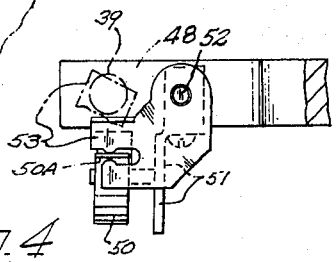
FIG. 4 is a plan view taken along line 4—4 of FIG. 1 showing thermostatic means for regulating induction air.

For the purpose of altering the fuel-air ratio during cold engine operation above idle speeds, I provide a bimetallic spring 50, as best viewed in FIG. 4, supported on arm 48 by means of a bracket 51 in place on said arm. A pivot pin 52 formed on the bracket rotatably mounts a plate 53 the latter positionable by the distal end 50A of bimetallic spring 50. Said spring is of the type expanding in the presence of cold engine temperatures to retract plate 53 about the axis of pin 52 whereby air adjustment screw 39 will have delayed contact with the upper surface of arm 48 resulting in reduced travel of butterfly 28. With plate 53 positioned outwardly from between adjustment screw 39 and arm 48, counterclockwise travel of control lever 34 will result in fuel metering in the normal manner as above described but with a lag occurring in the imparting of movement to butterfly 28 thereby lowering the ratio of air to fuel to enrich the mixture in barrel 11 until such time as engine temperature results in expansion of spring 50 to relocate plate 53 intermediate adjustment screw 39 and arm 48.

An idle control assembly is indicated generally at 54 which also is in operative association with lever 24 to control fuel metering during both idling and other high intake manifold vacuum periods of engine operation. An idle arm indicated at 55 is of angular configuration and rotatably mounted on spindle 43 to impart clockwise or lifting movement to lever 24 via an ear 55A. Indicated at 57 is a solenoid in circuit with the primary circuit of an automobile ignition system with a solenoid armature at 58 extensible upon the energizing of the primary circuit. Mounting a threaded solenoid collar 57A is a support 59 which in turn is slidably mounted on a bracket 60 by means of elongate openings 59A. Also supported by bracket 60 is a vacuum dash pot 61 having substantially conventional spring and diaphragm components positioning a stem 62 acting on slidably mounted solenoid support 59. A vacuum line 63 is in communication with the intake manifold and during conditions of high vacuum manifold pressures causes stem 62 to retract to reposition solenoid 57 and its armature 58 somewhat rearwardly (to the right) from the full line FIG. 1 position.

During a cold engine start, extension of armature 58 occurs to meter an initial fuel flow into conduit 26 with subsequent cold engine idling resulting in the rearward displacement of solenoid 57 and its armature permitting partial seating of core end 18A to provide a metered flow of fuel for idling.

An idle arm component 64 is pivoted at 65 while its upper end is responsive to the action of a bimetallic spring 66 carried by a flange 55B of the idle arm which spring contracts in the presence of elevated engine temperatures to mitigate the action of solenoid 57 and vacuum dash pot 61 on idle arm 55 thereby providing a reduced idle fuel flow during hot engine conditions. A hot idle adjustment screw is indicated at 67. A cold idle adjustment screw at 68 limits forward travel of bracket 58. Idle air intake is determined by the inclination of butterfly 28 which may be adjusted by backing off set screw 47 and repositioning shaft 32.

With attention to FIG. 1, details of the core end 18A are shown with the end 18A in the form of a needle valve having approximately a 2½° taper seated or closed within orifice 19A having a seating diameter of 0.128 thousandths of an inch. In a closed position, core spring 20 acts on a cruciform carrier 18B to seat end 18A within said orifice. Fuel discharged from orifice 19 enters the heated airflow from conduit 26 with the admixture of fuel particles and heated air passing into conduit 29 which may be of copper or other good heat conductive metal. Heat loss by conduction as well as by evaporation of fuel molecules into a vapor state reduces the admixture temperature prior to passage into a fuel nozzle arrangement generally at 71. Accordingly, undesirable loss of volumetric efficiency is avoided as induction air moving through barrel 11 remains substantially at its ambient temperature.

Figure 3:
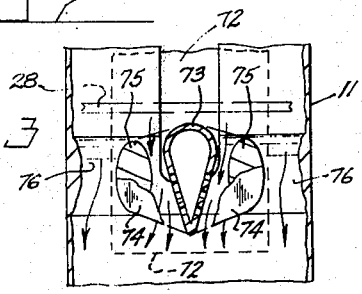
FIG. 3 is an elevational view taken along line 3—3 of FIG. 2 showing details of the fuel nozzle assembly.
Figure 2:
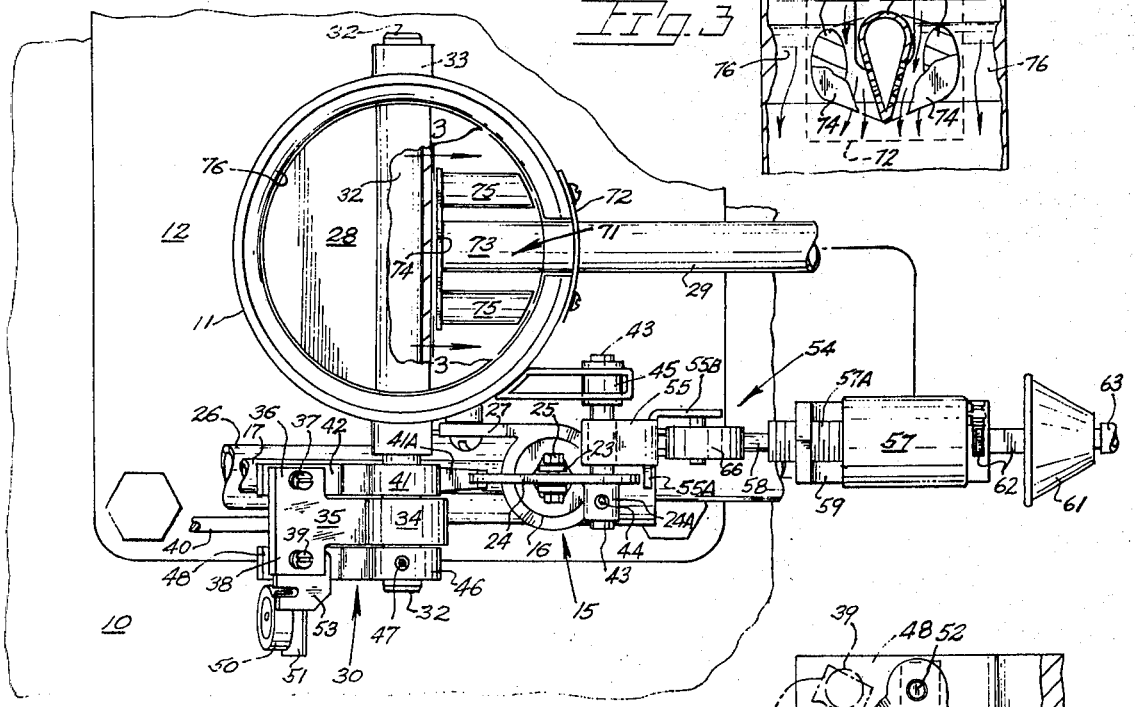
FIG. 2 is a top plan view of FIG. 1.

With attention to FIG. 3, the nozzle arrangement includes an adjustably mounting plate 72 on barrel 11 on which is secured a nozzle 73 of airfoil section. A crosspiece 74 mounts laterally spaced venturi members 75. The trailing or lower surfaces of the upright airfoil are perforate for discharge of the fuel-air mixture into induction air in barrel 11. While a negative pressure exists within barrel 11, to induce an airflow in conduits 29 and 26, an increase in negative pressure adjacent nozzle 73 is accomplished by venturi members 75 laterally spaced from nozzle 73. An annular venturi ring is indicated at 76.

With attention to FIG. 1, a source of filtered air is in communication with a heat exchanger arrangement as with an exhaust shroud S to provide a heated, filtered airflow to fuel metering means 15. The airflow through conduit 26 is induced by a negative pressure within barrel 11 through which an induction airflow passes as regulated by butterfly 28. As earlier mentioned, fuel is metered from orifice 19A upon core 18 being elevated in a needle valve like manner. Fuel in housing 16 is pressurized to 3 PSI by a pressure regulating device in line 17. Fuel entering the heated airflow in conduit 26 immediately atomizes with the mixture being carried toward the barrel nozzle via conduit 29. The atomization of fuel in conduit 29 results in a heat loss resulting in the atomized flow discharged by nozzle 73 being at a temperature substantially below the temperature of heated air in conduit 26 to provide a desired density within barrel 11. Accordingly, the two stage mixing takes advantage of a heated airflow for initial mixing purposes but avoids the undesirable aspects of discharging a heated fuel-air mixture flow into induction air. The induction air passing through barrel 11 may be heated by routing past an exhaust manifold prior to entry into conventional air filter means. If desired, an idle air adjustment may be applied to the free end of shaft 32, said adjustment including an arm and adjustment screw the latter abutting a stop on barrel 11 to permit adjustment of the butterfly position.

During engine operation, other than idle, the fuel-air linkage 30 and specifically arm 42, ring 41, tang 41A and lever 24 will regulate fuel flow from metering means 15. Simultaneous actuation of air arm 48 and butterfly 28 will regulate the flow of induction air into the upper end of barrel 11 with the flow being synchronized with the metered fuel flow.

During periods of deceleration with the vehicle throttle closed, the regulating of fuel flow is accomplished by the idle assembly 54, in addition to its normal idle flow regulating function. Vacuum dash pot 61 during high engine R.P.M. will be subjected to a high manifold vacuum resulting in stem 62 withdrawing solenoid 57 and its armature 58 out of biased contact with idler arm component 64 whereupon spring 20 of the fuel metering means will act to seat core end 18A to terminate fuel flow. The internal spring member within vacuum dash pot 61 is calibrated to reposition stem 62 forwardly or the left in FIG. 1 upon reduced manifold vacuum being reestablished as occurs when the automobile decelerates to a speed of approximately 25 miles per hour. In addition to a fuel savings the cut off during deceleration prevents any buildup of unburned hydrocarbons.

While I have shown but one embodiment of the invention it will be apparent to those skilled in the art that the invention may be embodied still otherwise without departing from the spirit and scope of the invention.

Having thus described the invention what is claimed and desired to be secured under Letters Patent is:

1. A fuel-air mixing apparatus for an internal combustion engine providing for the initial mixing of fuel with an airflow with the mixture subsequently being discharged into an induction airflow whereat final mixing occurs to vaporize the fuel, said apparatus comprising, fuel metering means including a positionable core, air conduit means in communication with said metering means providing a heated airflow into which fuel is metered to accomplish first stage mixing, said conduit means in downstream communication at a remote point with an induction airflow to the engine, a nozzle arrangement discharging the fuel-air mixture into the induction airflow, fuel and air linkage including a fuel-air control lever operated by the vehicle driver via throttle linkage, fuel and air regulating components actuated by said control, said fuel regulating component operable during open throttle conditions to regulate said fuel metering means, said air regulating component associated with an induction regulation valve whereby actuation of the fuel-air control will simultaneously regulate both a metered flow of fuel into the heated airflow and the flow of induction air with second stage mixing occurring in the induction airflow, an idle assembly regulating said fuel metering means during both idling and other closed throttle conditions, said idle assembly comprising, an idle arm for actuation of said positionable core of the fuel metering means, combination solenoid and vacuum responsive means acting on said idle arm to sequentially position the core for regulating fuel discharge during engine starting and the subsequent engine idling, temperature responsive means modifying the action of said combination of said idle arm under different temperature conditions, and said vacuum responsive means operable under closed throttle, high intake manifold vacuum conditions occurring during vehicle deceleration to close said fuel metering means to affect fuel conservation.

2. The fuel-air mixing apparatus as claimed in claim 1 wherein said fuel and air linkage includes temperature responsive means to lessen the air to fuel ratio during cold engine operation above idle speeds.

3. The fuel-air mixing apparatus as claimed in claim 2 wherein the temperature responsive means of the fuel and air linkage includes a bimetallic spring, a plate actuated by said spring into and out of positions between linkage components to provide differential travel of the linkage components under varying temperature conditions to alter the fuel-air ratio.

4. The fuel-air mixing apparatus as claimed in claim 1 additionally including core positioning means comprising a lever coupled to said core and positionable in response to movement of the fuel regulating component of the fuel and air linkage and also to movement of the idle arm of said idle assembly.

5. The fuel-air mixing apparatus as claimed in claim 4 including means enabling selective coupling of the valve core to said lever for the purpose of varying the effective stroke of said lever and hence core travel.

6. The fuel-air mixing apparatus as claimed in claim 1 wherein said idle arm includes a component positioned by the temperature responsive means of the idle assembly, said idle arm component disposed intermediate said combination solenoid and vacuum responsive means and the idle arm to modify the travel of said idle arm for different fuel-air ratios during hot and cold idling conditions.

7. The fuel-air mixing apparatus as claimed in claim 6 wherein said solenoid is slidably mounted, said vacuum responsive means includes a stem coupled to the solenoid to reposition same rearwardly to unload the idle arm during high intake manifold vacuum conditions permitting the positionable core to seat preventing fuel discharge until a reduction in manifold vacuum.

8. The fuel-air mixing apparatus as claimed in claim 1 wherein said nozzle arrangement includes a fuel nozzle of airfoil configuration section disposed transversely within the induction airflow, said nozzle defining fuel-air discharging perforations on opposed side surfaces.

9. The fuel nozzle arrangement as claimed in claim 8 additionally including venturi members oppositely spaced from a fuel nozzle to contribute towards the formation of reduced pressure areas in the induction airflow adjacent each of the nozzle sides.

10. The fuel-air mixing apparatus as claimed in claim 8 wherein said nozzle arrangement additionally includes mounting means adjustably secured to an air induction member enabling the positioning of the fuel nozzle relative to a superjacent air induction valve.

11. The fuel-air mixing apparatus as claimed in claim 1 wherein said fuel-air control lever includes a fuel-air arm jointly mounting fuel and air adjustment means thereon, each of said fuel-air adjustment means contactable respectively with said fuel and air regulating components upon arcuate positioning of the control lever by driver controlled throttle linkage.

12. The fuel-air mixing apparatus as claimed in claim 11 wherein said fuel-air control lever is supported for independent rotatable movement about a shaft mounting a butterfly valve regulating induction airflow.

13. The fuel-air mixing apparatus as claimed in claim 12 wherein said fuel regulating component is also supported for independent rotatable movement about the shaft mounting said butterfly valve.

* * * * *